US007938735B2

(12) United States Patent
Lau

(10) Patent No.: US 7,938,735 B2
(45) Date of Patent: May 10, 2011

(54) GOLF CLUB ADAPTER

(75) Inventor: Alan G. Lau, Glendale Heights, IL (US)

(73) Assignee: Grooved, Inc., Glendale Heights, IL (US)

( * ) Notice: Subject to any disclaimer, the term of this patent is extended or adjusted under 35 U.S.C. 154(b) by 0 days.

(21) Appl. No.: 12/117,636

(22) Filed: May 8, 2008

(65) Prior Publication Data

US 2008/0280696 A1 Nov. 13, 2008

Related U.S. Application Data

(60) Provisional application No. 60/928,138, filed on May 8, 2007.

(51) Int. Cl.
*A63B 53/02* (2006.01)

(52) U.S. Cl. ..... 473/288; 473/307

(58) Field of Classification Search ..... 473/314, 473/288, 305–307
See application file for complete search history.

(56) References Cited

U.S. PATENT DOCUMENTS

| | | | | |
|---|---|---|---|---|
| 2,425,808 | A * | 8/1947 | Jakosky | 473/246 |
| 4,948,132 | A | 8/1990 | Wharton | |
| 5,184,819 | A * | 2/1993 | Desbiolles | 473/309 |
| 6,186,903 | B1 | 2/2001 | Beebe et al. | |
| 6,431,993 | B1 | 8/2002 | Dyer | |
| 6,575,843 | B2 | 6/2003 | McCabe | |
| 6,669,573 | B2 * | 12/2003 | Wood et al. | 473/246 |
| 6,769,994 | B2 * | 8/2004 | Boone | 473/245 |
| 7,207,897 | B2 * | 4/2007 | Burch et al. | 473/288 |
| 7,335,113 | B2 * | 2/2008 | Hocknell et al. | 473/307 |
| 2003/0100379 | A1 * | 5/2003 | Ingram | 473/305 |
| 2003/0220149 | A1 | 11/2003 | Mills | |
| 2005/0176521 | A1 * | 8/2005 | Burch et al. | 473/305 |

* cited by examiner

*Primary Examiner* — Stephen L. Blau

(74) *Attorney, Agent, or Firm* — Erickson Law Group, PC

(57) ABSTRACT

An adaptor for a golf club having a golf club head with a head hosel socket and a golf shaft includes an adapter body that includes an adapter shaft portion and an adapter hosel portion. The adapter hosel portion has an adapter hosel socket sized and shaped to receive an end portion of a golf club shaft. The adapter shaft portion is sized and shaped to fit into a head hosel socket of the club head. The adapter hosel socket longitudinal axis and the adapter shaft portion longitudinal axis are angularly offset by a selected offset angle. To change the loft and lie angles of a particular golf club for a particular golfer, a plurality of selectable adapters can be provided with different offset angles.

7 Claims, 3 Drawing Sheets

GOLF CLUB ADAPTER

This application claims the benefit of Provisional Application Ser. No. 60/928,138, filed May 8, 2007.

BACKGROUND OF THE INVENTION

The basic construction of golf club iron and driver assemblies is made up of a club head having a particular lie and loft angle, shaft and hand grip. The iron or driver club head forms the striking member at a pre-selected loft angle for a desired distance and at a pre-selected lie angle for swing height that is a combination of a golfer's shaft length and stance position. The shaft of the club is the connecting member that connects the golf club head to the golfer's hand grip. Today's golf shafts come in a range of stiffness from rigid to flexible within different locations of the shaft and is sometimes referred to as the engine.

The loft angle of any club head is the angle at which the face of the club lies relative to a vertical direction. Loft gives distance with height of the golf ball travel. Golf club drivers are the least-lofted clubs, golf club irons are the most-lofted, and golf putters have no loft. Golf club driver lofts for most golfers run between 7.5 and 12.5 degrees. Golf club iron and driver head increase in loft through the set until reaching the lob wedge, which is usually lofted around 60 to 64 degrees.

The present inventor has recognized that golfers have their own swing height and natural swing stance position due to their different height, weight, body type and arm lengths. The present inventor has recognized that it is difficult for all golfers to play their best and get maximum benefit from today's shafts with manufactured off-the-shelf golf clubs. The present inventor has recognized that the standard lie and loft angle of each manufactured off-the-shelf golf club head is different between manufacturers and will not fit every golfer perfectly. Manufactured off-the-shelf golf club head tolerances are basically one club up or down. The present inventor has recognized that the combination of a golfer's swing height and their natural swing stance position with manufactured off-the-shelf clubs requires the player to adjust their golf swing and stance to a manufacturers lie angle in hitting the golf ball. Golfers who use manufactured off-the-shelf club heads run the risk of pulling or pushing shots. The present inventor has recognized that this is because they have not been fitted perfectly to the lie angle that relates best to their own swing height and natural swing stance position.

The lie angle of any club head is the angle between the shaft and the sole of the club head. The present inventor has recognized that the lie angle of club heads should be fitted for each golfer for at least three major reasons:

1.) The lie angle will maintain the consistency of the golfer's golf swing.

2.) The lie angle is a factor that affects the accuracy of the shot. The lie angle is considered to be perfect when the sole of the club arrives at impact, perfectly parallel to the ground. The toe or the sole of the club should not arrive ahead of one another. A flat, flush or level impact defines the correct force on the club face to the ball. If the toe or the sole of the club arrive ahead of one another or if the head or the sole are higher or lower then than one another, the club head is misaligned to the target. This misalignment results in a variety of ball flight patterns that sends the ball in a direction not intended.

3.) The lie angle tolerance of manufactured golf club head angles vary in range of multiple degrees and will create difference in inches for the swing height. Lie angles and shaft length are designated differently by different off-the-shelf manufacturers for their considered golfer's segmented market average height.

SUMMARY OF THE INVENTION

The present invention provides an adaptor that is an attachment to be part of the assembly for a golf club iron or golf club driver. The adaptor of the present invention should be hard enough to not be bendable, not fracture from golf play and be a precise permanent method to adjust club head lie and loft angles. The adaptor of the present invention allows a golfer to adjust manufactured off-the-shelf golf clubs to their natural swing and stance when hitting the golf ball into the air. The adaptor of the present invention is an addition to the golf club head, the shaft and the hand grip and is located between the golf club head and the shaft golf club end.

The adaptor of the present invention is an attachment that could be used with manufactured off-the-shelf golf club heads. Using different angled adaptors of the present invention adjusts the manufactured club head lie to best align golfers swing height and natural swing stance position. Rotating the adaptor of the present invention from lie angle center allows the golfer to adjust a more desired swing loft fit from manufactured off-the-shelf club heads.

The adaptor of the present invention can be of a one or two piece construction and either creates a club head neck extension while setting lie and loft angles. In extending the golf club head neck it increases the stiff feeling of the shaft making a flexible shaft have a stiff feel while still maintaining the benefits of flexible shaft.

According to one embodiment, a one piece adaptor has a hosel socket that is angled to provide an adjustment to the manufactured off-the-shelf club heads lie and loft angles. The one piece adaptor in combination of design, assembly and material allows actual field usage with a golf game.

According to a second embodiment, a two piece adaptor has a shaft socket that is angled to provide an adjustment to the manufactured off-the-shelf club heads lie and loft angles. The two piece adaptor locks together to become one fixed piece. The locking is accomplished with different common shaft locking methods of screw thread, pin lock and twist lock. The two piece adaptor locking feature allows easier disassembly and re-assembly between different assemblies of a hosel socket with shaft assembly with the different manufactured off-the-shelf golf club heads. The two piece adaptor in combination of design, easier locking assemble and material strength allows actual field trial usage with a golf game and permits an easier golf club head and shaft interchangeability.

Numerous other advantages and features of the present invention will be become readily apparent from the following detailed description of the invention and the embodiments thereof, and from the accompanying drawings.

DETAILED DESCRIPTION OF THE PREFERRED EMBODIMENTS

Figure 1:
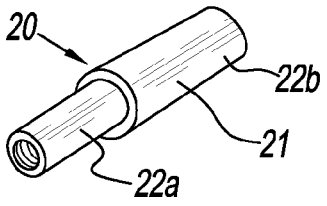
FIG. 1 is a front perspective view of a golf club adaptor of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Golf clubs are typically assembled by inserting the shaft assembly into a hosel of the club head and then bonding with adhesive. The adhesive is softened with heat for easy disassembly and reassembly of golf clubs. The shaft end of the adaptor of the present invention is designed to be engaged coaxially into the golf club hosel; and the hosel socket of the adaptor is engaged coaxially to the golf club shaft assembly end. The adaptor placement to lie angle center adds or subtracts from manufactured off-the-shelf club head lie and loft angles. The adaptor is bonded with adhesive at the golf club head and at the golf club shaft end.

FIG. 1 illustrates a first embodiment adaptor 20 of the present invention comprising a one piece body 21 that includes a shaft portion 22*a* and a hosel portion 22*b*.

Figure 2:
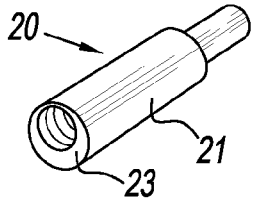
FIG. 2 is a rear perspective view of the golf club adaptor shown in FIG. 1.

FIG. 2 Illustrates the hosel portion 22*b* having a hosel socket 23.

Figure 3:
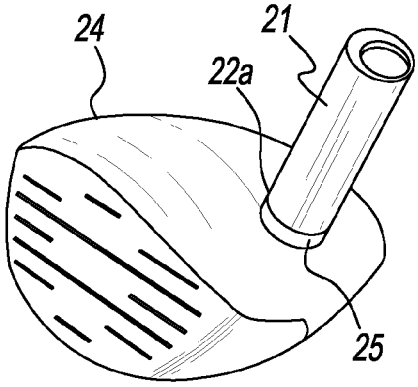
FIG. 3 is a top perspective view of the golf club adaptor of FIG. 1, shown installed on a golf club head.

FIG. 3 Illustrates the adaptor 20 mounted to a club head 24, particularly by the shaft portion 22*a* fitting into a hosel socket 25 of the club head 24. This shaft portion 22*a* engages coaxially within the club head hosel socket 25.

Figure 4:
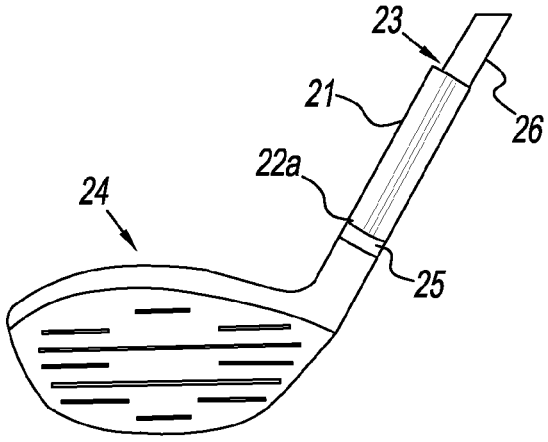
FIG. 4 is a fragmentary elevation view of the golf club adaptor of FIG. 1 installed between a golf club head and a golf club shaft.

FIG. 4 Illustrates the adaptor shaft portion 22*a* mounted within the club head hosel socket 25 and a golf club shaft 26 engage coaxially into the adaptor hosel socket 23.

Figure 5:
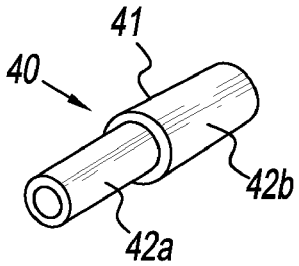
FIG. 5 is a front perspective view of a second embodiment golf club adaptor of the present invention.

FIG. 5 Illustrates a second embodiment adapter 40 of the present invention comprising a two-piece body 41. The body includes a shaft portion 42*a* and a hosel portion 42*b*.

Figure 6:
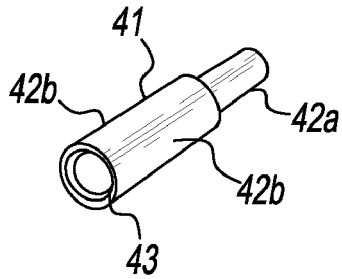
FIG. 6 is a rear perspective view of the golf club adaptor shown in FIG. 5.

FIG. 6 Illustrates the adaptor hosel portion 42*b* having a hosel socket 43.

Figure 7:
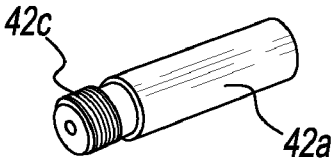
FIG. 7 is a rear perspective view of a first portion of the golf club adaptor shown in FIG. 5.

FIG. 7 Illustrates the adaptor shaft portion 42*a* separated from the hosel portion 42*b*.

Figure 8:
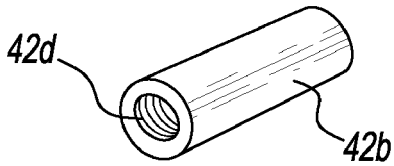
FIG. 8 is a front perspective view of a second portion of the golf club adaptor shown in FIG. 5.

FIG. 8 Illustrates the adaptor hosel portion 42*b* separated from the shaft portion 42*a*.

As can be understood, to assemble the adaptor 40, a threaded end portion 42*c* of the shaft portion 42*a* is threaded into a threaded socket 42*d* of the adaptor hosel portion 42*b*.

Figure 9:
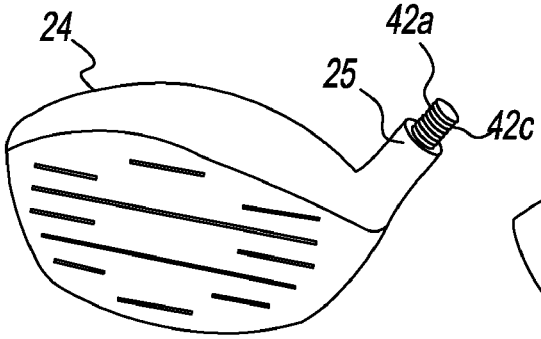
FIG. 9 is a top perspective view of the portion of the golf club adaptor of FIG. 7, shown installed on a golf club head.

FIG. 9 Illustrates the shaft portion 42*a* engaged coaxially into the golf club head hosel 25 with the threaded end portion 42*c* protruding.

Figure 10:
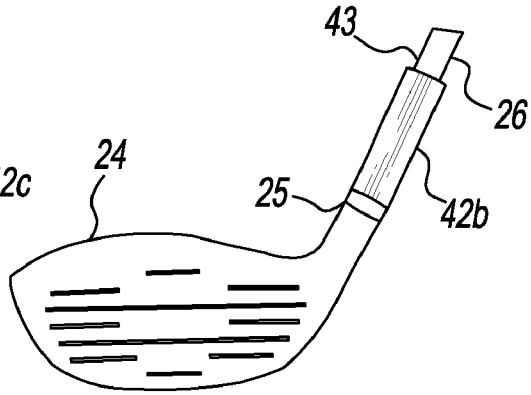
FIG. 10 is a fragmentary elevation view of the golf club adaptor of FIG. 5 installed between a golf club head and a golf club shaft.

FIG. 10 Illustrates the further assembly of the adaptor 40 and the golf club. The hosel portion 42*b* is threaded onto the shaft portion, particularly, the threaded socket 42*d* is tightly threaded down onto the threaded end portion 42*c*. The golf club shaft 26 is installed coaxially into the hosel socket 43 of the hosel portion 42*b*.

Figure 11:
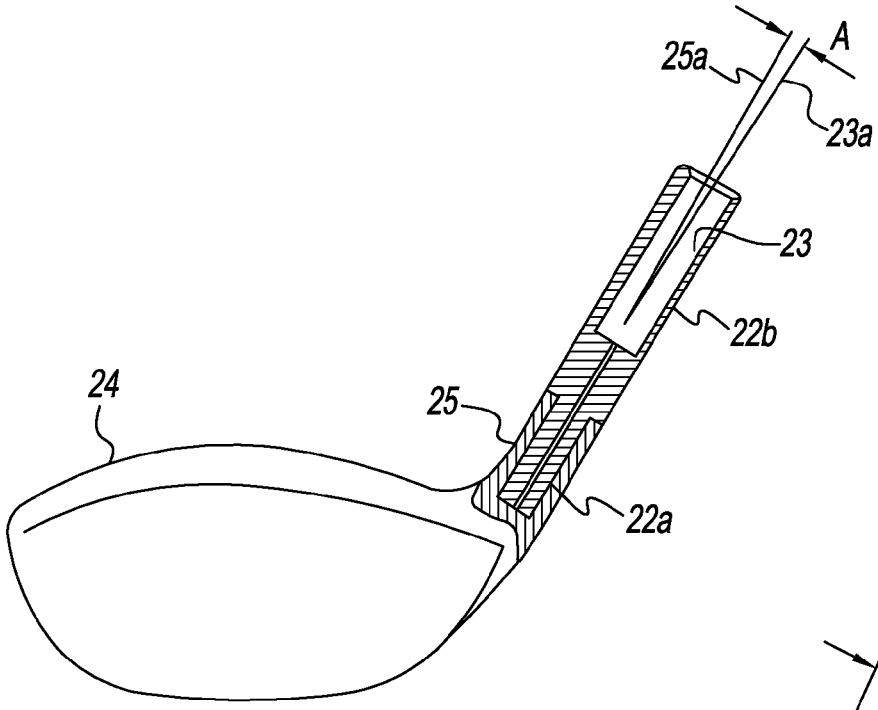
FIG. 11 is a longitudinal cross-sectional view of the golf club head, golf club adaptor and golf club shaft shown in FIG. 4.

FIG. 11 Illustrates in cross-section the adaptor 20 mounted into the club head hosel socket 25. This adaptor shaft portion 22*a* engages coaxially within the hosel socket 25 and is fixed by adhesive. The hosel portion 22*b* is substantially coaxial with the shaft portion 22*a*. However, the hosel socket 23 extends into the hosel portion 22*b* at an angle to the hosel portion 22*b*. The adaptor hosel socket 23 has a longitudinal axis 23*a* and the club head hosel has a longitudinal axis 25*a*. According to the invention, the axes 23*a*, 25*a* are offset by a pre-selected angle A. The angle A can be selected to fit the particular golfer and sets the lie angle of the club head.

Figure 12:
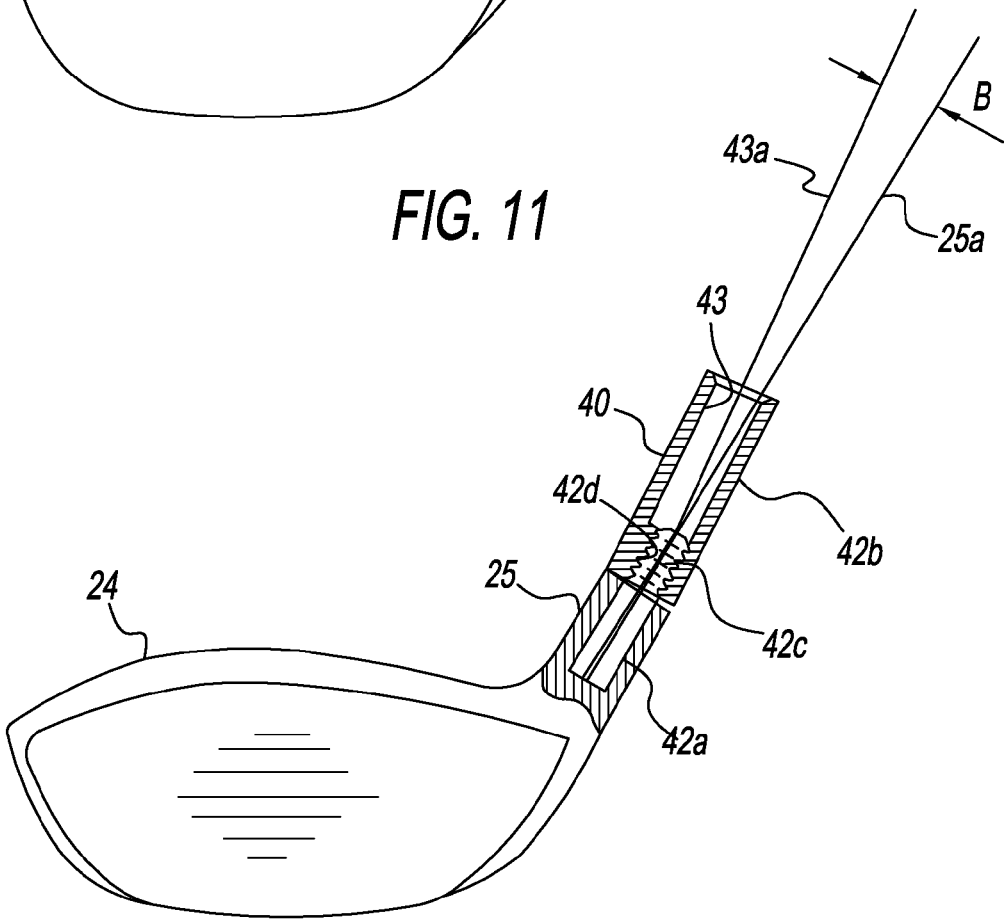
FIG. 12 is a longitudinal cross-sectional view of the golf club head, golf club adaptor and golf club shaft shown in FIG. 10.

FIG. 12 Illustrates in cross-section the adaptor 40 mounted to the club head 24. The club head hosel socket 25 has the longitudinal axis 25*a*. The shaft threaded end portion 42*c* also shares this axis 25*a*. The adaptor hosel portion 42*b* and the hosel socket 43 share a longitudinal axis 43*a*. The threaded socket 42*d* formed into the hosel portion 42*b* shares the axis 25*a*. The axes 25*a*, 43*a* are offset by a pre-selected angle B. The angle B can be selected to fit the particular golfer and sets the lie angle of the club head.

The adaptors 20, 40 according to exemplary embodiments of the invention can be made of material that is not bendable and is composed of high end Aluminum, example 7075, or Titanium. The material should be hard and not be too brittle to fracture during play. The adaptor of exemplary embodiments of the invention can have an angle A or B range from 0.5 degrees through 6 degrees. The range tolerance of the adaptor of the present invention can be plus or minus 0.5 degrees and can be a 0.5 degree improvement from manufactured off-the-shelf golf club heads specified with 2 degrees of range. The adaptors 20, 40 can be designed to fit into standard golf club diameters for both golf club head hosel and golf club shaft: 0.335", 0.350", 0.355", 0.370", 390" and 0.410".

The adaptors 20, 40 are fixed to the golf club head 24 and golf club shaft 26 by adhesive deposited within the respective hosel 25, 23, 43.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. An adaptor for a golf club having a golf club head with a head hosel socket and a golf shaft, the adapter comprising:

an adapter body that includes an adapter shaft portion and an adapter hosel portion, the adapter hosel portion having an adapter hosel socket in a first end portion sized and shaped to receive an end portion of a golf club shaft and having an adapter hosel socket longitudinal axis, and having a second end portion opposite the adapter hosel socket, the adapter hosel portion being shaped as a straight cylinder without any axial bends or kinks, the adapter shaft portion having a first end portion sized and shaped to fit into a head hosel socket of the club head, and an opposite second end portion, one of the adapter hosel portion second end portion and the adapter shaft portion second end portion having a connection socket, and the respective other of said adapter hosel portion second end portion and the adapter shaft portion second end portion having a connection shaft sized and shaped to be fixed into the connection socket, the connection socket and the connection shaft having a common longitudinal axis, said adapter hosel socket longitudinal axis and said adapter shaft portion longitudinal axis being angularly offset by an offset angle, wherein said adapter shaft portion and said adapter hosel portion being two separate pieces that have a joint therebetween;

wherein said adapter hosel portion has an adapter hosel portion longitudinal axis, and said adapter hosel portion longitudinal axis and said adapter hosel socket longitudinal axis are substantially collinear, said common longitudinal axis being collinear with said adapter shaft portion longitudinal axis, wherein said adapter hosel socket longitudinal axis is angularly offset from said common longitudinal axis by said offset angle.

2. The adaptor according to claim 1, comprising a plurality of said adapter hosel portions, wherein the adapter hosel portions can be provided with the offset angle selectable in degree increasing increments.

3. The adapter according to claim 1, wherein the adapter hosel portion second end portion has the connection socket, which is threaded, and the adapter shaft portion second end portion has the connection shaft which is threaded and sized and shaped to be threadingly engaged into the connection socket.

4. The adaptor according to claim 1, wherein said offset angle ranges from 0.5 degrees to 6 degrees.

5. The adaptor according to claim 1, wherein the connection socket and the connection shaft are threaded for mutual engagement.

6. The adaptor according to claim 1, wherein said adaptor is composed of aluminum.

7. The adaptor according to claim 1, wherein said adaptor is composed of titanium.

* * * * *